US007614345B1

(12) United States Patent
Schiller et al.

(10) Patent No.: US 7,614,345 B1
(45) Date of Patent: Nov. 10, 2009

(54) IMPACT SWITCH

(75) Inventors: Ronnie Schiller, Ridgecrest, CA (US); Wayne Goodrich, Ridgecrest, CA (US)

(73) Assignee: The United States of America as represented by the Department of the Navy, Washington, DC (US)

( * ) Notice: Subject to any disclaimer, the term of this patent is extended or adjusted under 35 U.S.C. 154(b) by 24 days.

(21) Appl. No.: 12/128,549

(22) Filed: May 28, 2008

Related U.S. Application Data

(63) Continuation of application No. 11/169,335, filed on Jun. 27, 2005, now abandoned.

(51) Int. Cl.
*F42C 19/07* (2006.01)

(52) U.S. Cl. ..... 102/216; 102/252

(58) Field of Classification Search ..... 102/216, 102/227, 230, 234, 239, 252, 257, 266, 272, 102/202.1
See application file for complete search history.

(56) References Cited

U.S. PATENT DOCUMENTS 2,887,056 A * 5/1959 Perret ..... 102/216
3,158,705 A * 11/1964 Bliss ..... 200/61.08
3,380,384 A * 4/1968 Kaiser et al. ..... 102/266
3,577,923 A * 5/1971 Perkins et al. ..... 102/472
3,621,163 A * 11/1971 Hitchcock ..... 200/61.45 R
3,715,985 A * 2/1973 Fugelso ..... 102/216
3,783,791 A * 1/1974 Backstein et al. ..... 102/216
3,903,805 A * 9/1975 Hovnanian ..... 102/207
4,036,143 A * 7/1977 Nordgren et al. ..... 102/216
4,174,666 A * 11/1979 Lucey et al. ..... 102/216
4,581,507 A * 4/1986 Bai et al. ..... 200/61.45 R
5,088,413 A * 2/1992 Huber et al. ..... 102/202.5
5,387,257 A * 2/1995 Tari et al. ..... 102/226
5,853,149 A * 12/1998 Vo et al. ..... 244/121
5,914,459 A * 6/1999 Teske et al. ..... 102/262
6,105,504 A * 8/2000 Ayres et al. ..... 102/220

* cited by examiner

*Primary Examiner*—Michael Carone
*Assistant Examiner*—Benjamin P Lee
(74) *Attorney, Agent, or Firm*—Christopher Blackburn

(57) ABSTRACT

An apparatus and a method to initiate a detonation utilizing an impact switch. A nose assembly is mounted upon a missile or other kind of explosive device. Within the nose assembly conductive elements are separated from one another. The conductive elements are electrically connected to a fuze within the weapon. Upon an impact, the conducting elements within the assembly are forced together thereby completing a circuit in the fuze and initiating a detonation. A method of initiating a detonation utilizes an impact switch within which forcing conducting elements together initiates a detonation.

10 Claims, 1 Drawing Sheet

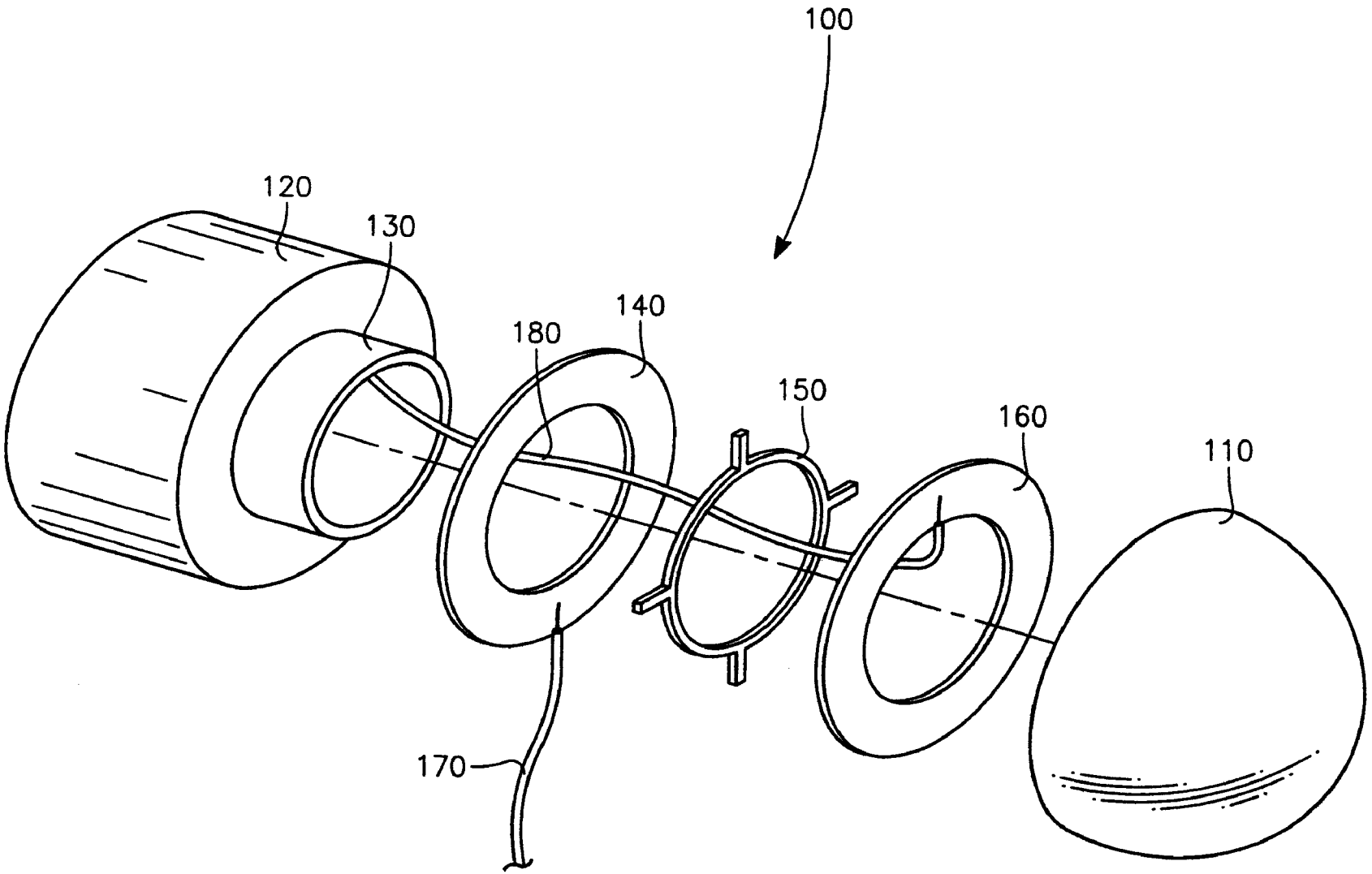
100
110
160
150
140
180
170
130
120

IMPACT SWITCH

This application is a continuation of U.S. patent application Ser. No. 11/169,335, filed Jun. 27, 2005, now abandoned.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

In order to provide suitable and operational weapon systems for the military it is necessary to test weapons in circumstances simulating conditions as close as possible to actual conditions. For example, it would be desirable to test missiles hitting actual targets. Unfortunately, the missile and target are frequently destroyed and usable laboratory data is difficult to gather.

To test missiles actually striking targets, a gas powered gun may be used to fire a missile at a target in a laboratory environment. The gas gun may be configured so as to fire the missile precisely, arriving with the same properties at the target as if it were actually fired at the target. But the acceleration of the missile leaving the gas gun is significantly higher than accelerations experienced by the missile in actual flight, frequently causing a premature detonation of the missile or a failure of the missile to detonate. In addition, the deceleration of the missile after leaving the gas gun may also cause a premature detonation of the missile. Therefore, there is a need for a replacement nose assembly for experimental use to allow the missile to strike a target without premature detonation and thus allow the collection of valid and useful laboratory data.

BRIEF DESCRIPTION OF THE DRAWINGS

FIG. 1 illustrates an exploded view of an embodiment of the invention.

DESCRIPTION OF THE EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation. In the FIGURE, the same reference numbers are used to identify the same components.

Embodiments of the invention include an apparatus and a method to initiate a detonation utilizing an impact switch. A nose assembly is mounted upon a missile or other kind of explosive device. Within the nose assembly conductive elements are separated from one another. The conductive elements are electrically connected to a fuze within the weapon. Upon an impact, the conducting elements within the assembly are forced together thereby completing a circuit in the fuze and initiating a detonation. A method of initiating a detonation utilizes an impact switch within which forcing conducting elements together initiates a detonation.

FIG. 1 illustrates an exploded view of an embodiment of the invention. An impact switch includes a nose assembly 100 having a nose bottom 120 and a nose top 110 that are substantially hollow and that fit upon one another. The nose assembly 100 is constructed with dimensions suitable for the missile or other weapon it is mounted upon. Some examples of missiles or weapons that may utilize embodiments of the invention are the Stinger, Redeye, SA-7, SA-16, SA-18, any Man Portable Air Defense missiles (foreign or domestic), 2.75" & 5" rockets, freefall bombs, Sidewinder, Sparrow, or AMRAAM. The nose bottom 120 shall have an extended section 130 that is dimensioned and configured to fit within the nose top 110 when the nose assembly 100 is fit together. The nose top 110 and nose bottom 120 are fabricated of materials sufficient to withstand the accelerations associated with firing the missile and possessing electrical insulating properties, such as, but not limited to acrylic, glass, ceramic, lexan, PVC, PolyEthylene, Polypropylene HDPE, UHMW, sapphire, fiberglass, glass or aramid composites, or phenolic and phenolic composites.

An embodiment of the invention includes a conducting bottom ring 140 fixed to the nose bottom 120 and positioned around the extended section 130 of nose bottom 120 in the manner shown in the figure. In addition, the end of a first conductor 170 leading to the fuze (not shown) is attached to the bottom ring 140. In one embodiment the first conductor 170 is attached to the bottom ring 140 by soldering, but other methods of connection may be contemplated by those of skill in the art. A conducting top ring 160 is positioned adjacent to the nose top 110 and is also positioned so as to fit around the extended section 130 of nose bottom 120. One end of a second conductor 180 leading to the fuze (not shown) is attached to the top ring 160. The conductors 170 and 180 are constructed from a conducting material such as, for example, copper wire. The conducting rings 140 and 160 are constructed of a conducting material suitable to the accelerations experienced by the nose assembly 100, such as, but not limited to copper, brass, steel, aluminum, bronze, tin, or an electrically conducting composite.

An embodiment of the invention includes an insulating spacer ring 150, positioned upon the extended section 130 of nose bottom 120 between the top ring 160 and the bottom ring 140. The spacer ring 150 is dimensioned and configured so as to keep the conducting rings 140 and 160 from touching one another inadvertently but so that the rings can touch upon sufficient impact. The spacer ring 150 is constructed of an insulating material such as, but not limited to acrylic, glass, ceramic, lexan, PVC, PolyEthylene, Polypropylene HDPE, UHMW, sapphire, fiberglass, glass or aramid composites, or phenolic and phenolic composites.

The nose top 110 and the nose bottom 120 are fixed to one another, creating a sealed enclosure to protect the assembly from inadvertent contact of the conducting rings 140 and 160 or shorting of the conductors 170 and 180 during handling and launch of the missile. The nose top 110 and nose bottom 120 are joined or fixed together utilizing a fixative agent such as, but not limited to glue, epoxy, cynoacrylate, organic bonding agents (such as gorilla glue), silicone, RTV, or molten plastic (as in plastic welding). Upon impact with a target or another surface, the bottom ring 140 and the top ring 160 are crushed together and forced around the spacer 150 to touch one another, electrically connecting the conductors 170 and 180. The conductors 170 and 180, being connected to a fuze, complete a circuit to the fuze thereby causing a detonation.

Another embodiment of the invention includes a method for initiating a detonation. The embodiment includes providing an impact switch with a nose assembly 100 having a nose bottom 120 and a nose top 110 that are substantially hollow, the nose bottom 120 having an extended section 130 that is dimensioned and configured to reside within the nose top 110, a conducting bottom ring 140 connected to the nose bottom 120 and positioned upon the extended section 130 of the nose bottom 120, the conducting bottom ring 120 connected to an end of a first conductor 170 of a fuze, a conducting top ring 160 positioned adjacent to the nose top 110 and positioned upon the extended section 130 of the nose bottom 120, the conducting top ring 160 connected to an end of a second conductor 180 of the fuze, an insulating spacer ring 150 positioned between the top ring 160 and the bottom ring 140 wherein the nose top 110 and the nose bottom 120 are fixedly connected to one another; forcing by an impact the bottom ring 140 and the top ring 160 to touch one another; and connecting electrically the first and second conductors (170 and 180), thereby initiating a detonation.

It is to be understood that the foregoing detailed description is exemplary and explanatory only and is not to be viewed as being restrictive of embodiments of the invention, as claimed. The invention is capable of other and different embodiments, and its several details are capable of modifications in various obvious respects, all without departing from the invention. Accordingly, the drawings and description are to be regarded as illustrative in nature, and not as restrictive. Thus the scope of this invention should be determined by the appended claims, drawings and their legal equivalents.

What is claimed is:

1. An impact switch comprising:

a nose assembly a having nose bottom and a nose top that are substantially hollow;

said nose bottom having an extended section that is dimensioned and configured to reside within said nose top, said extended section of said nose bottom being constructed of insulating material;

a conducting bottom ring having an inner diameter larger than the diameter of at least a portion of said extended section, the conducting bottom ring being connected to said nose bottom and positioned upon said extended section of said nose bottom such that at least a portion of said extended section passes through said conducting bottom ring, said conducting bottom ring being connected to an end of a first conductor of a fuze;

a conducting top ring having an inner diameter larger than the diameter of at least a portion of said extended section, the conducting top ring being positioned adjacent to said nose top and positioned upon said extended section of said nose bottom such that at least a portion of said extended section passes through said conducting top ring, said conducting top ring being connected to an end of a second conductor of said fuze;

an insulating spacer ring positioned between said conducting top ring and said conducting bottom ring;

wherein said nose top and said nose bottom are fixedly connected to one another; and wherein upon an impact said bottom ring and said top ring contact one another to form an electrical connection between said first conductor and said second conductor.

2. The impact switch of claim 1 wherein said nose top and said nose bottom are constructed of materials selected from the group of construction materials consisting of acrylic, glass, ceramic, lexan, PVC, PolyEthylene, Polypropylene HDPE, UHMW, sapphire, fiberglass, glass composite, aramid composite, phenolic, and phenolic composite.

3. The impact switch of claim 1 wherein said first and second conducting rings are constructed of a material selected from the group of construction materials consisting of copper, brass, steel, aluminum, bronze, tin, and electrically conductive composite.

4. The impact switch of claim 1 wherein said spacer ring is constructed of a material selected from the group of construction materials consisting of acrylic, glass, ceramic, lexan, PVC, PolyEthylene, Polypropylene HDPE, UHMW, sapphire, fiberglass, glass composite, aramid composite, phenolic, and phenolic composite.

5. The impact switch of claim 1 wherein said nose top and said nose bottom are fixedly connected utilizing glue, epoxy, cynoacrylate, organic bonding agents, silicone, RTV, or molten plastic.

6. A method for initiating a detonation comprising:

providing an impact switch having a nose assembly having a nose bottom and a nose top that are substantially hollow wherein said nose bottom has an extended section that is constructed of insulating material and dimensioned and configured to reside within said nose top, wherein a conducting bottom ring having an inner diameter larger than the diameter of at least a portion of the extended section is connected to said nose bottom and positioned upon said extended section of said nose bottom such that at least a portion of the extended section passes through the conducting bottom ring, wherein said conducting bottom ring is fixedly connected to a first conductor of a fuze, wherein a conducting top ring having an inner diameter larger than the diameter of at least a portion of said extended section positioned adjacent to said nose top and positioned upon said extended section of said nose bottom such that at least a portion of the extended section passes through the conducting top ring, wherein said conducting top ring is fixedly connected to a second conductor of said fuze, wherein an insulating spacer ring is positioned between said conducting top ring and said conducting bottom ring, wherein said nose top and said nose bottom are fixedly connected to one another; and subjecting said impact switch to an impact sufficient to cause said bottom ring and said top ring to contact one another to form an electrical connection between said first conductor and said second conductor, thereby closing an electrical circuit to initiate a detonation.

7. The method of claim 6 wherein said nose top and said nose bottom are constructed of materials selected from the group of construction materials consisting of acrylic, glass, ceramic, lexan, PVC, PolyEthylene, Polypropylene HDPE, UHMW, sapphire, fiberglass, glass composite, aramid composite, phenolic, and phenolic composite.

8. The method of claim 6 wherein said first and second conducting rings are constructed of a material selected from the group of construction materials consisting of copper, brass, steel, aluminum, bronze, tin, and electrically conductive composite.

9. The method of claim 6 wherein said spacer ring is constructed of a material selected from the group of construction materials consisting of acrylic, glass, ceramic, lexan, PVC, PolyEthylene, Polypropylene HDPE, UHMW, sapphire, fiberglass, glass composite, aramid composite, phenolic, and phenolic composite.

10. The method of claim 6 wherein said nose top and said nose bottom fixedly connected utilizing of glue, epoxy, cynoacrylate, organic bonding agents, silicone, RTV, or molten plastic.

* * * * *